US011176804B1

(12) United States Patent
Piccolo, III

(10) Patent No.: US 11,176,804 B1
(45) Date of Patent: Nov. 16, 2021

(54) SYSTEMS AND METHODS FOR CONTROLLING ADDRESSABLE COMBINED INITIATING DEVICE AND NOTIFICATION APPLIANCE CIRCUITS

(71) Applicant: Johnson Controls Fire Protection LP, Boca Raton, FL (US)

(72) Inventor: Joseph Piccolo, III, Fitzwilliam, NH (US)

(73) Assignee: Johnson Controls Fire Protection LP, Boca Raton, FL (US)

( * ) Notice: Subject to any disclaimer, the term of this patent is extended or adjusted under 35 U.S.C. 154(b) by 0 days.

(21) Appl. No.: 16/904,290

(22) Filed: Jun. 17, 2020

(51) Int. Cl.

| | |
|---|---|
| ***G08B 25/00*** | (2006.01) |
| ***G08B 29/06*** | (2006.01) |
| ***G08B 3/10*** | (2006.01) |
| ***G08B 17/02*** | (2006.01) |
| ***G08B 5/22*** | (2006.01) |
| ***G08B 17/10*** | (2006.01) |

(52) U.S. Cl.
CPC ..... *G08B 25/008* (2013.01); *G08B 3/10* (2013.01); *G08B 5/22* (2013.01); *G08B 17/02* (2013.01); *G08B 17/10* (2013.01); *G08B 29/06* (2013.01)

(58) Field of Classification Search
CPC ..... G08B 25/008; G08B 5/22; G08B 3/10; G08B 29/06; G08B 17/10; G08B 17/02
See application file for complete search history.

(56) References Cited

U.S. PATENT DOCUMENTS

| | | | | |
|---|---|---|---|---|
| 5,966,002 | A * | 10/1999 | Barrieau | G08B 17/10 323/222 |
| 6,426,697 | B1 * | 7/2002 | Capowski | G08B 3/10 340/3.1 |
| 6,459,370 | B1 * | 10/2002 | Barrieau | G08B 29/06 324/522 |
| 6,567,001 | B1 * | 5/2003 | Barrieau | G08B 29/06 340/3.1 |
| 9,761,099 | B1 * | 9/2017 | Barth | G08B 13/08 |
| 10,966,154 | B2 * | 3/2021 | Chiarizio | G08B 17/10 |
| 2004/0145465 | A1 * | 7/2004 | Stults | G08B 25/008 340/521 |
| 2007/0262857 | A1 * | 11/2007 | Jackson | G06T 7/70 340/506 |
| 2014/0270714 | A1 * | 9/2014 | Osminer | H04N 21/4147 386/296 |

(Continued)

*Primary Examiner* — Ojiako K Nwugo
(74) *Attorney, Agent, or Firm* — Arent Fox LLP

(57) ABSTRACT

Aspects of the present disclosure provide addressable detection and alarm systems and methods for controlling a combined circuit by a control panel. In an example, a combined circuit may include one or more addressable initiating devices and one or more non-addressable notification appliances communicatively coupled with paired wires in parallel. The control panel may receive, on the paired wires, an indication of an anomaly from an addressable initiating device and transmit, on the paired wires, the alarm signal to the one or more addressable initiating devices and the one or more non-addressable notification appliances, wherein a first state of the alarm signal activates the one or more non-addressable notification appliances and deactivates the one or more addressable initiating devices, and wherein a second state of the alarm signal deactivates the one or more non-addressable notification appliances and activates the one or more addressable initiating devices.

20 Claims, 6 Drawing Sheets

(56) References Cited

U.S. PATENT DOCUMENTS

| | | | | |
|---|---|---|---|---|
| 2015/0022346 | A1* | 1/2015 | Fadell | G05B 11/01 340/533 |
| 2016/0071402 | A1* | 3/2016 | Chiarizio | H04B 1/713 340/539.17 |
| 2018/0122221 | A1* | 5/2018 | Norton | G08B 25/08 |
| 2020/0150264 | A1* | 5/2020 | Barson | G08B 13/08 |
| 2020/0327799 | A1* | 10/2020 | Barson | G08B 17/10 |
| 2020/0402380 | A1* | 12/2020 | Barson | G08B 5/36 |

* cited by examiner

SYSTEMS AND METHODS FOR CONTROLLING ADDRESSABLE COMBINED INITIATING DEVICE AND NOTIFICATION APPLIANCE CIRCUITS

TECHNICAL FIELD

The present disclosure generally relates to systems and methods for detection and alarm systems, in particular systems and methods for controlling addressable combined initiating device and notification appliance circuits.

BACKGROUND

Detection and alarm systems such as fire detection and alarm systems are often used at public and private premises, such as households, commercial buildings, businesses, retail establishments, schools, hospitals and government buildings, to list a few examples. In general the detection and alarm systems are divided into two types of systems: addressable systems and non-addressable systems. Addressable systems use addressable devices which may allow control panels to communicate and control specific devices in the system due to due to unique device identifiers. Non-addressable systems do not include addressable devices and therefore rely on control panels to send signals to one or more initiating device circuits or one or more notification appliance circuits in the systems. While addressable systems provide fast response times, there is a need for more efficient and cost effective solutions for addressable systems.

SUMMARY

The following presents a simplified summary of one or more implementations of the present disclosure in order to provide a basic understanding of such implementations. This summary is not an extensive overview of all contemplated implementations, and is intended to neither identify key or critical elements of all implementations nor delineate the scope of any or all implementations. The sole purpose of this summary is to present some concepts of one or more implementations of the present disclosure in a simplified form as a prelude to the more detailed description that is presented later.

In an aspect, an addressable detection and alarm system is provided. The addressable detection and alarm system may include a combined circuit including paired wires, one or more addressable initiating devices, and one or more non-addressable notification appliances communicatively coupled with the paired wires in parallel. The addressable detection and alarm system may include a control panel having a controller communicatively coupled with the combined circuit via the paired wires and the memory. The controller may be configured to receive, on the paired wires, an indication of an anomaly from an addressable initiating device of the one or more initiating devices. The controller may be configured to determine to transmit an alarm signal in response to the indication of the anomaly being received. The controller may be configured to transmit, on the paired wires, the alarm signal to the one or more addressable initiating devices and the one or more non-addressable notification appliances, wherein a first state of the alarm signal activates the one or more non-addressable notification appliances and deactivates the one or more addressable initiating devices, and wherein a second state of the alarm signal deactivates the one or more non-addressable notification appliances and activates the one or more addressable initiating devices.

In another aspect, a method of controlling, by a control panel, a combined circuit including paired wires, one or more initiating devices, and one or more non-addressable notification appliances communicatively coupled with the paired wires in parallel, is provided. The method may include receiving, on the paired wires, an indication of an anomaly from an addressable initiating device of the one or more initiating devices. The method may include determining to transmit an alarm signal in response to the indication of the anomaly being received. The method may include transmitting, on the paired wires, the alarm signal to the one or more addressable initiating devices and the one or more non-addressable notification appliances, wherein a first state of the alarm signal activates the one or more non-addressable notification appliances and deactivates the one or more addressable initiating devices, and wherein a second state of the alarm signal deactivates the one or more non-addressable notification appliances and activates the one or more addressable initiating devices.

In another aspect, a computer-readable medium storing instructions for controlling addressable detection and alarm system comprising a control panel, a combined circuit including paired wires, one or more initiating devices, and one or more non-addressable notification appliances communicatively coupled with the paired wires in parallel, is provided. The computer-readable medium may include instructions to receive, on the paired wires, an indication of an anomaly from an addressable initiating device of the one or more initiating devices. The computer-readable medium may include instructions to determine to transmit an alarm signal in response to the indication of the anomaly being received. The computer-readable medium may include instructions to transmit, on the paired wires, the alarm signal to the one or more addressable initiating devices and the one or more non-addressable notification appliances, wherein a first state of the alarm signal activates the one or more non-addressable notification appliances and deactivates the one or more addressable initiating devices, and wherein a second state of the alarm signal deactivates the one or more non-addressable notification appliances and activates the one or more addressable initiating devices.

Additional advantages and novel features relating to implementations of the present disclosure will be set forth in part in the description that follows, and in part will become more apparent to those skilled in the art upon examination of the following or upon learning by practice thereof.

DESCRIPTION OF THE FIGURES

The novel features believed to be characteristic of the disclosure are set forth in the appended claims. In the descriptions that follow, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objects and advances thereof, will be best understood by reference to the following detailed description of illustrative aspects of the disclosure when read in conjunction with the accompanying drawings, wherein:

DETAILED DESCRIPTION

Figure 1A:
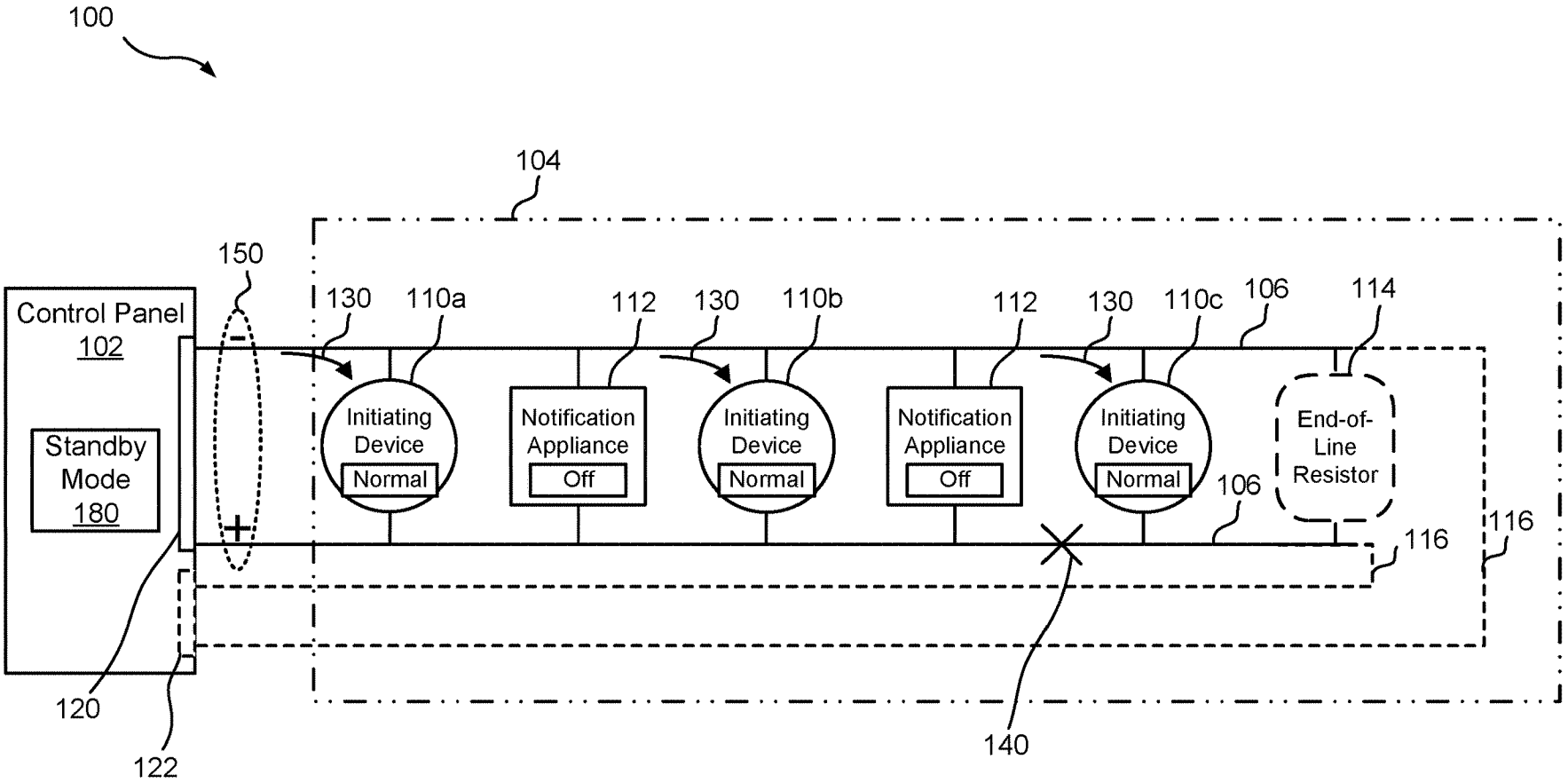
FIGS. 1A-1C illustrate conceptual views of an example addressable detection and alarm system in different modes, in accordance with aspects of the present disclosure.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known components may be shown in block diagram form in order to avoid obscuring such concepts.

In a typical addressable detection and alarm system, a control panel monitors different zones of a building, where each zone includes two circuits: an initiating device circuit having a plurality of addressable initiating devices, and a notification appliance circuit having a plurality of notification appliances. In a typical system, the control panel polls the addressable initiating devices on the initiating device circuit to determine if an anomaly, such as fire, smoke, or a pull switch, has been detected by one or more of the initiating devices. If one or more of the addressable initiating devices responds to the control panel that an anomaly has been detected, the control panel signals to the notification appliances on the notification appliance circuit to send out an alarm. Use of separate circuits allows for a simple addressable system and allows the control panel to individually monitor and control each of the circuits independently of each other.

Aspects of the present disclosure provide addressable detection and alarm systems and methods for controlling a combined circuit (or single circuit), including addressable initiating devices and non-addressable notification appliances, by a control panel. Use of the systems and methods provided herein may reduce the costs for panel equipment and devices, reduce the amount of panel equipment (e.g., one circuit used instead of two circuits), reduce the overall installation cost, and provide a less complex system, as compared to other addressable detection and alarm systems.

In the present disclosure an addressable detection and alarm system is provided to include a control panel and a combined circuit having one or more addressable initiating devices and one or more non-addressable notification appliances. As described herein, an addressable device includes a device having a discrete identification and that can have a status individually checked and/or identified by the control panel. Initiating devices are devices that provide input to a control panel to indicate an anomaly and may be activated either manually or automatically. Examples of the addressable initiating devices include, but are not limited to, smoke detectors, heat detectors, pull switches, or call points having discrete identifications. Notification appliances are devices that output, in response to instructions from the control panel, an audible alert, a visual alert, or some other form of stimuli to alert building occupants of the anomaly. Examples of the notification appliances include, but are not limited to, audible alarms such as horns or visual alarms such as strobe lights.

Turning now to the figures, example aspects are depicted with reference to one or more components described herein, where components in dashed lines may be optional.

Figure 1B:
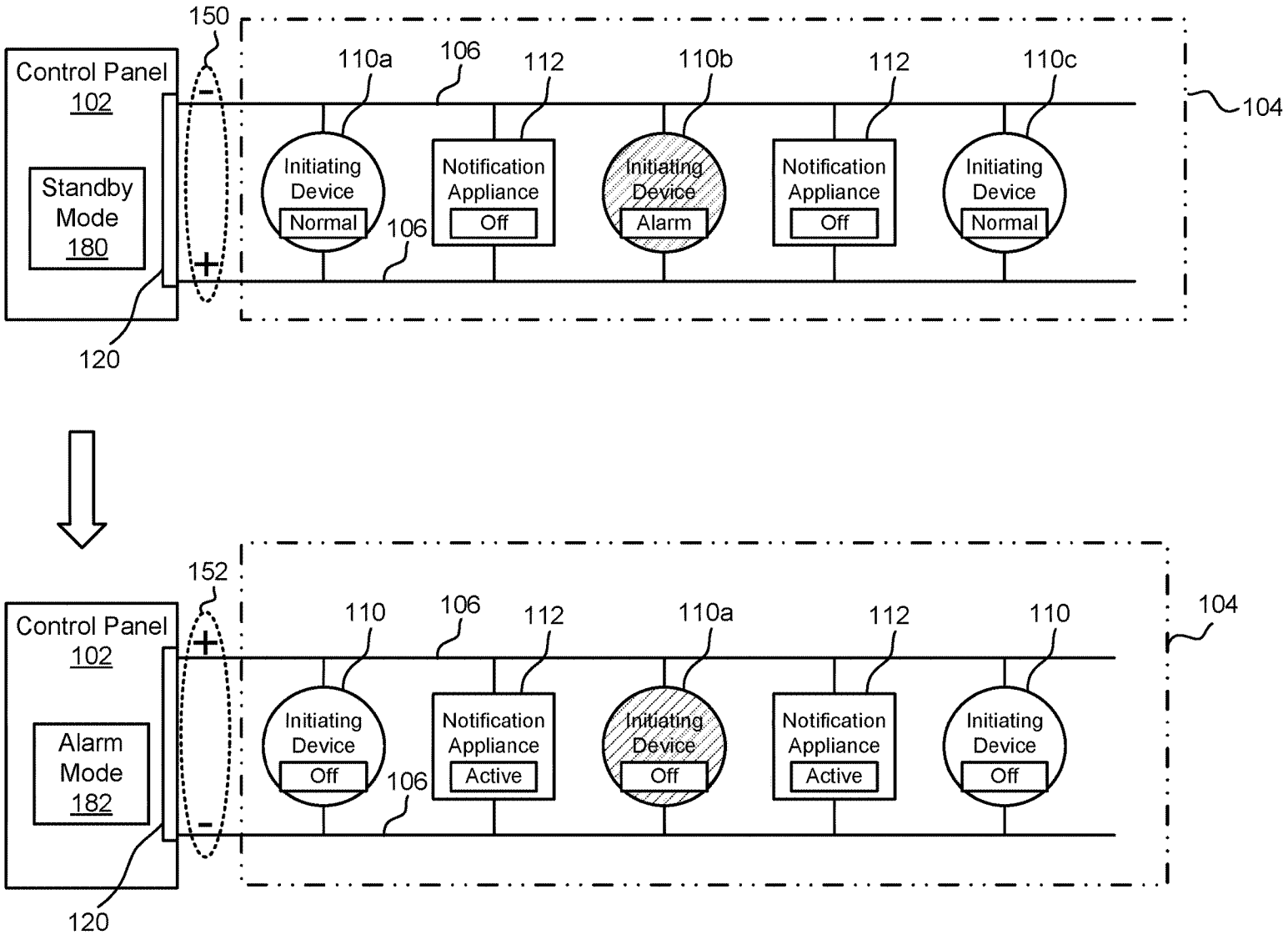
Figure 1C:
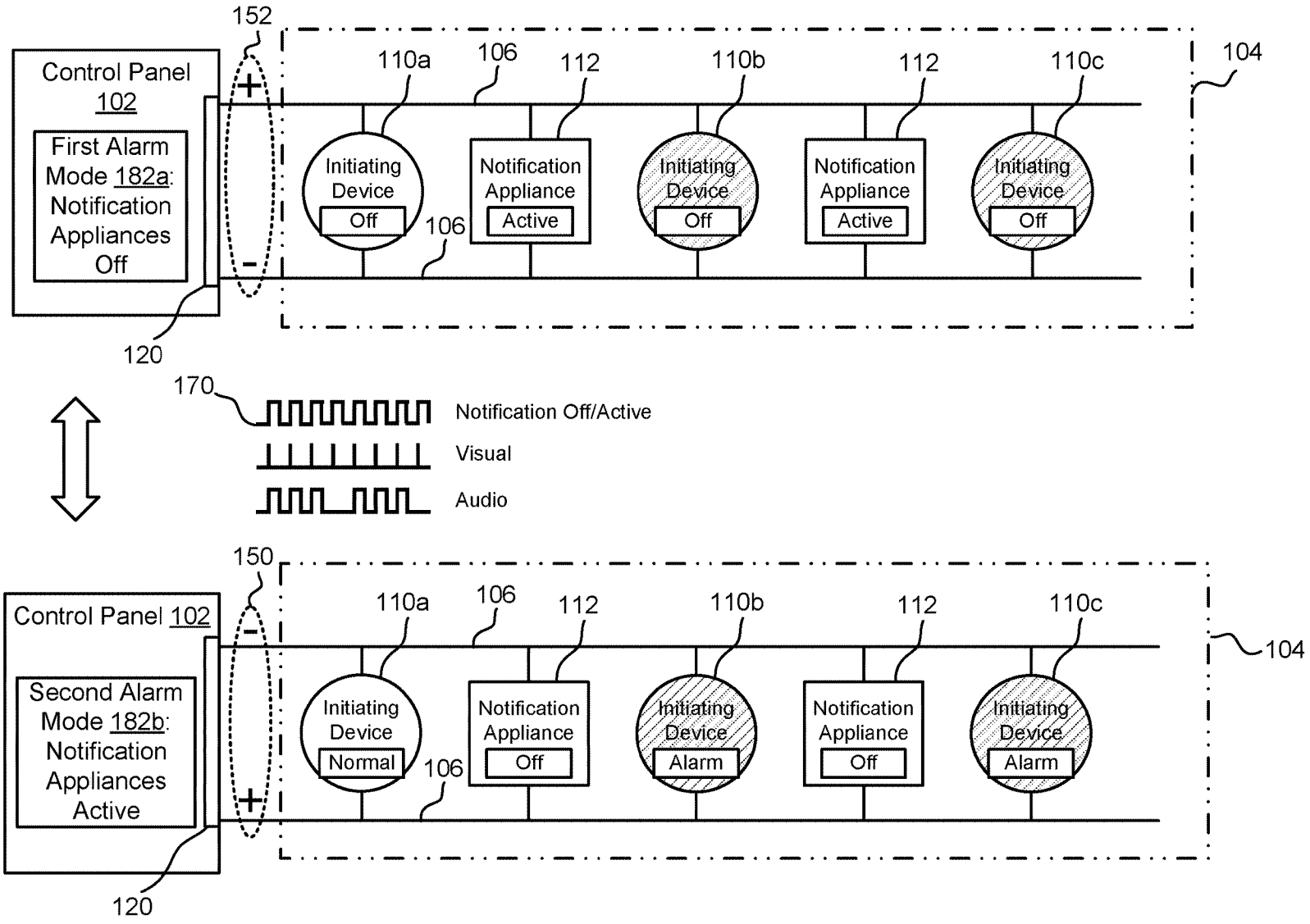

Referring to FIG. 1A-1C, an example addressable detection and alarm system 100 is depicted in different modes including the addressable detection and alarm system 100 in a standby mode (FIG. 1A), the addressable detection and alarm system 100 transitioning from a standby mode to an alarm mode (FIG. 1B), and the addressable detection and alarm system 100 in the alarm mode (FIG. 1C). In an aspect, the detection and alarm system 100 may include a control panel 102 communicatively coupled with a combined circuit 104. The combined circuit 104 may include one or more addressable initiating devices 110 and one or more non-addressable notification appliances 112 connected in parallel between paired wires 106. The combined circuit 104 may transmit both communications signals and operating power over the paired wires 106. In an example, the combined circuit 104 may communicatively couple with the control panel 102 via a primary interface 120. The control panel 102 may include a memory which stores identification information of each of the addressable initiating devices 110 on the combined circuit 104 and, in some examples, location information of the addressable initiating devices 110.

In an aspect, the control panel 102 may monitor the combined circuit 104 for a cut or broken wire of the paired wires 106 using one of the following wire monitoring configurations. In one configuration, the combined circuit 104 may include an end-of-line resistor 114 communicatively coupled between the paired wires 106 in parallel with the one or more initiating devices 110 and the one or more notification appliances 112. The end-of-line resistor 114 may allow the control panel 102 to monitor for a cut or broken wire 140 of the paired wires 106. In an example, the control panel 102 monitors an amount of current that passes through the paired wires 106 due to the end-of-line resistor 114, and when the current is removed, the control panel 102 determines that a wire of the paired wire 106 is cut or broken. The combined circuit 104 including the end-of-line resistor 114 is known as a Class B configuration.

In an alternative configuration, the combined circuit 104 may not include the end-of-line resistor 114. Instead, the combined circuit may include a return line 116 communicatively coupled between the paired wires 106 and a secondary interface 122 of the control panel 102. The return line 116 may allow the detection and alarm system 100 to continue communications with the initiating devices 110 and the notification appliances 112 when a wire of the paired wire 106 is cut or broken. The combined circuit 104 including the return line 116 (i.e., without the end-of-line resistor 114) is known as a Class A configuration.

As either configuration may be used without change to the combined circuit 104, further description and illustration of the end-of-line resistor 114 or the return line 116 is not provided in the following examples.

In an aspect, the control panel 102 may operate in a standby mode 180, as illustrated by FIG. 1A, in which alarm monitoring is performed. In the standby mode 180, the non-addressable notification appliances 112 are in a standby state (or "off state" with low power draw). For example, the control panel 102 may apply a first polarity 150 across the paired wires 106 while in the standby mode 180 to maintain the non-addressable notification appliances 112 in the standby state.

Further, in the standby mode 180, the addressable initiating devices 110 are in a normal state (or "on state") for communicating with the control panel 102. While the addressable initiating devices 110 are in the normal state, the control panel 102 may monitor (e.g., via polling signal 130) the addressable initiating devices 110 to determine whether an anomaly such as fire, smoke, or a pull switch is detected, and may receive individual status communications from the addressable initiating devices 110. When no anomaly is detected by the addressable initiating devices 110, each may report a normal status to the control panel 102 in response to the polling signal 150.

Turning to FIG. 1B, when an anomaly has been detected by one of the addressable initiating devices 110, the state of that addressable initiating device 110 changes to an alarm state. For example, as illustrated by FIG. 1B, when the addressable initiating device 110*b* detects an anomaly, the state of the addressable initiating device 110*b* changes to the alarm state. Further, the addressable initiating device 110*b* may transmit and the control panel 102 may receive the alarm status indicating that the presence of the anomaly has been detected. For example, if the addressable initiating device 110*b* is a pull switch, when the pull switch has been pulled, the addressable initiating device 110*b* may communicate the alarm status indicating to the control panel 102 that the pull switch has been pulled. In another example, if the addressable initiating device 110*b* is a smoke detector, when the smoke sensor detects smoke, the addressable initiating device 110*b* may communicate the alarm status indicating to the control panel 102 that the smoke alarm has detected smoke. Once the control panel 102 receives the alarm status of the initiating device 110*b*, the control panel 102 transitions from the standby mode 180 to an alarm mode 182. In the alarm mode 182, the control panel 102 may deactivate the addressable initiating devices 110*a-c* and activate the non-addressable notification appliances 112, as illustrated by FIG. 1B. For example, the control panel 102 may apply a second polarity 152 (different from the first polarity) across the paired wires 106 while in the alarm mode 182 to change the non-addressable notification appliances 112 to the active state.

In the alarm mode 182, the addressable detection and alarm system 100 may use an alternating alarm operation, as illustrated by FIG. 1C. According to this aspect, the control panel 102 may alternate between a first alarm mode 182*a* and a second alarm mode 182*b* based on a notification signal 170 on being output by the control panel 102 on the paired wires 106. In an example, the notification signal 170 may be configured to switch between the first alarm mode 182*a* and the second alarm mode 182*b* using a pulsed signal, as illustrated by FIG. 1C. For example, the first alarm mode 182*a* may be activated when the pulse is high or at a logic "1," and the second alarm mode 182*b* may be activated when the pulse is low or at a logic "0." However, in other examples, the first alarm mode 182*a* may be activated when the pulse is high or at a logic "0," and the second alarm mode 182*b* may be activated when the pulse is low or at a logic "1." The notification signal 170 transmitted by the control panel 102 may thereby switch between the monitoring of the addressable initiating devices 110 and the control of the non-addressable notification appliances 112, while the control panel 102 is in the alarm mode 182. Further, different non-addressable notification appliances 112 may synchronize based on a rise of pulse or a number of pulses. For example, a visual alert (e.g., strobe light) may synchronize on each rise of a pulse and an audio alert (e.g., horn) may synchronize for on the rise of a few pulses before pausing and then repeating.

In the first alarm mode 182*a*, the non-addressable notification appliances 112 are in an active state (or on state) to allow the non-addressable notification appliances 112 to provide an alert of the anomaly while the addressable initiating devices 110*a-c* are in an off state (or standby state). For example, the non-addressable notification appliances 112 may sound an alarm and/or strobe a light to provide an alert of the anomaly.

In the second alarm mode 182*b*, the addressable initiating devices 110 are in the normal state (or on state) to allow these devices to continue detecting anomalies while the non-addressable notification appliances 112 are in an off state (or standby state). As shown by FIG. 1C, in the second alarm mode 182*b*, the addressable initiating device 110*c* may also detect the anomaly (e.g., short from pull switch or smoke from smoke detector) thereby confirming the anomaly detected by the addressable initiating device 110*b*.

The addressable detection and alarm system 100 disclosed herein may reduce installation complexity and costs due to the use of a combined circuit including a paired wire line being run for both the addressable initiating devices 110 and the non-addressable notification appliances 112. Also, the addressable detection and alarm system 100 provides flexibility by supporting both Class A and Class B configurations, as described herein.

Figure 2:
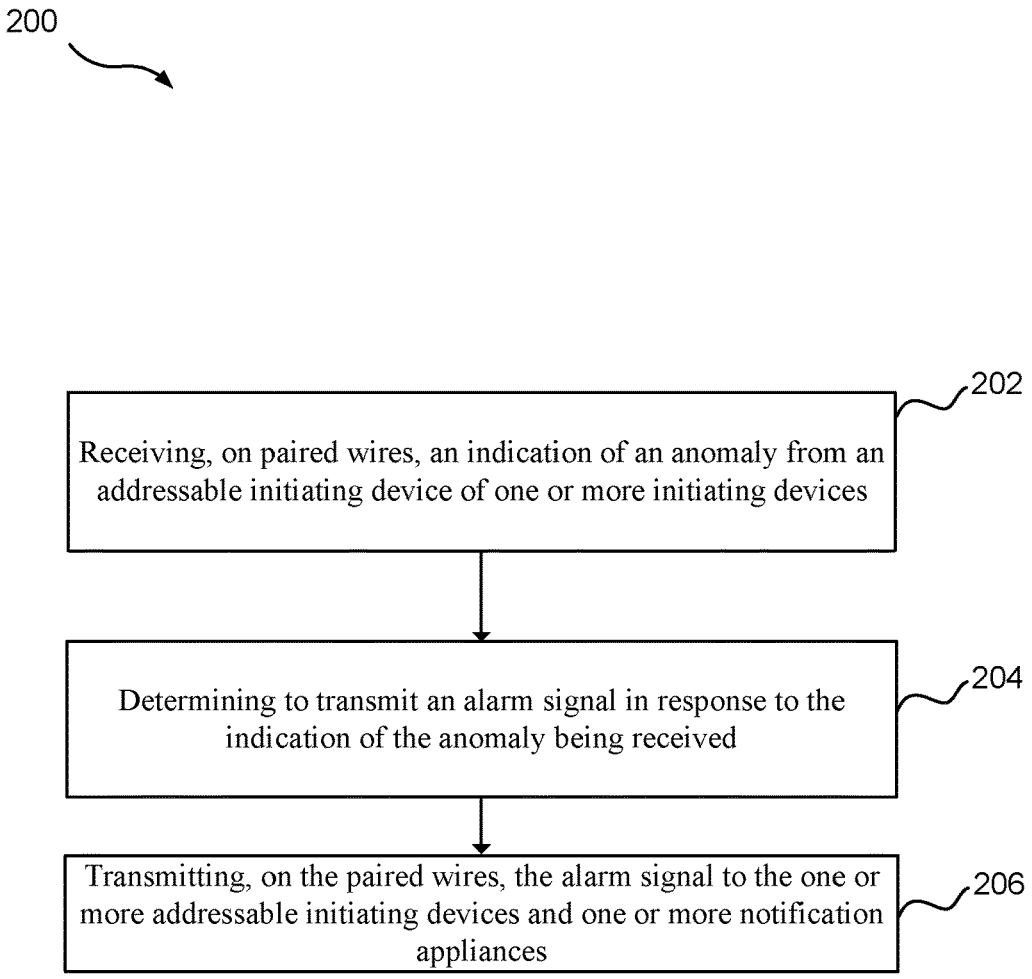
FIG. 2 is a flowchart of an example method of operation by the addressable detection and alarm system of FIGS. 1A-1C, in accordance with aspects of the present disclosure.

Referring to FIG. 2, an example method 200 of the operation of and interactions between various modules of the addressable detection and alarm system 100 is disclosed. FIGS. 1A-1C may be referenced in combination with the flowchart of FIG. 2. In an example, the method 200 is implemented by one or more of the control panel 102, a computer system (e.g., computer system 300 of FIG. 3), a controller (e.g., processor 304 of FIG. 3), and/or one or more components/subcomponents, as described herein.

At 202, the method 200 may include receiving, on paired wires, an indication of an anomaly from an addressable initiating device of one or more initiating devices. In an example, one or more of the control panel 102, the computer system 300, the processor 304, and/or one or more components/subcomponents may receive, on the paired wires 106, an indication of an anomaly from the addressable initiating device 110*b*. In an example, the indication of the anomaly may be received while the control panel 102, the computer system 300, the processor 304, and/or one or more components/subcomponents is in a standby mode.

In an aspect, while the control panel 102, the computer system 300, the processor 304, and/or one or more components/subcomponents is in the standby mode, the control panel 102, the computer system 300, the processor 304, and/or one or more components/subcomponents may monitor the one or more addressable initiating devices 110, maintain the one or more non-addressable notification appliances 112 in an off state, and transition to an alarm mode in response to receiving the indication of the anomaly.

At 204, the example method 200 may also include determining to transmit an alarm signal in response to the indication of the anomaly being received. In an example, one or more of the control panel 102, the computer system 300, the processor 304, and/or one or more components/subcomponents may determine to transmit the alarm signal 170 in response to the indication of the anomaly being received. For example, the indication of the anomaly may be a communication from the addressable initiating devices

110*b* that smoke has been detected (if the addressable initiating devices 110*b* is a smoke detector) or that the addressable initiating devices 110*b* has been pulled (if the addressable initiating devices 110*b* is a pull switch), and one or more of the control panel 102, the computer system 300, the processor 304, and/or one or more components/subcomponents may determine to transmit the alarm signal 170 based on the communication.

At 206, the example method 200 may also include transmitting, on the paired wires, the alarm signal to the one or more addressable initiating devices and the one or more non-addressable notification appliances. In an example, one or more of the control panel 102, the computer system 300, the processor 304, and/or one or more components/subcomponents may transmit, on the paired wires 106, the alarm signal 170 to the one or more addressable initiating devices 110 and the one or more non-addressable notification appliances 112. In an example, a first state of the alarm signal activates the one or more non-addressable notification appliances and deactivates the one or more addressable initiating devices, and a second state of the alarm signal deactivates the one or more non-addressable notification appliances and activates the one or more addressable initiating devices. In an example, the alarm signal 170 is a pulsed signal. In an example, the first state of the alarm signal is a first binary logic state and the second state of the alarm signal is a second binary logic state different from the first binary logic state. In an example, one or more of the control panel 102, the computer system 300, the processor 304, and/or one or more components/subcomponents may monitor the one or more addressable initiating devices 110 in the second state of the alarm signal 170.

Figure 3:
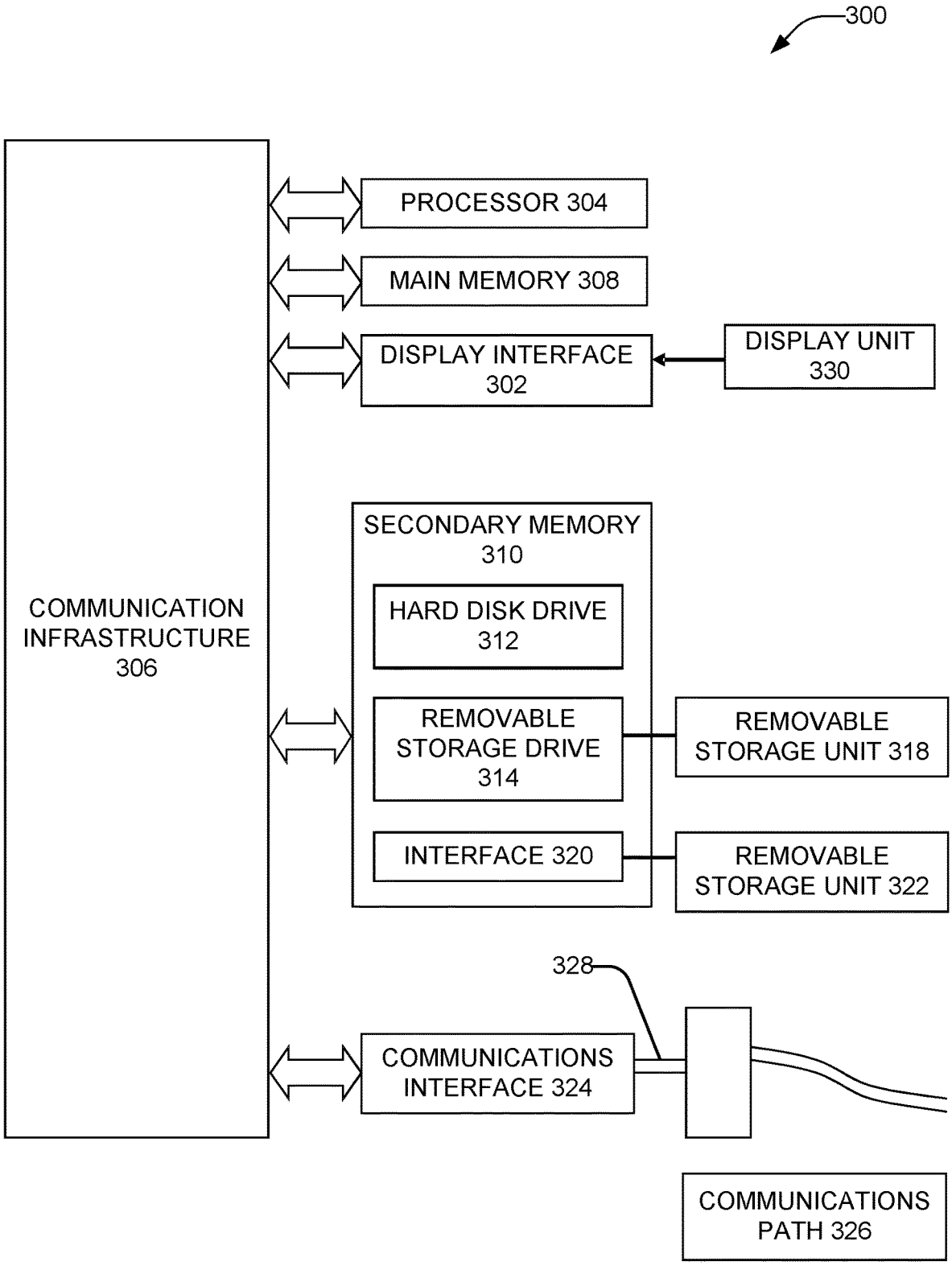
FIG. 3 is a block diagram of an example of various hardware components and other features of a computer system that operate the addressable detection and alarm system of FIGS. 1A-1C, in accordance with aspects of the present disclosure.

Aspects of the present disclosure may be implemented using hardware, software, or a combination thereof and may be implemented in one or more computer systems or other processing systems. In one aspect, the disclosure is directed toward one or more computer systems capable of carrying out the functionality described herein. FIG. 3 presents an example system diagram of various hardware components and other features that may be used in accordance with aspects of the present disclosure. Aspects of the present disclosure may be implemented using hardware, software, or a combination thereof and may be implemented in one or more computer systems or other processing systems. In one example variation, aspects of the disclosure are directed toward one or more computer systems capable of carrying out the functionality described herein. An example of such a computer system 300 is shown in FIG. 3. In an example, the computer system 300 may be an example of the control panel 102, described herein.

The computer system 300 includes one or more processors, such as the processor 304. The processor 304 is connected to the communication infrastructure 306 (e.g., a communications bus, cross-over bar, or network). Various software aspects are described in terms of this example computer system. After reading this description, it will become apparent to a person skilled in the relevant art(s) how to implement aspects of the disclosure using other computer systems and/or architectures.

The processor 304, or any other "processor," as used herein, processes signals and performs general computing and arithmetic functions. Signals processed by the processor 304 may include digital signals, data signals, computer instructions, processor instructions, messages, a bit, a bit stream, or other computing that may be received, transmitted and/or detected.

The communication infrastructure 306 refers to an interconnected architecture that is operably connected to transfer data between computer components within a singular or multiple systems. The bus may be a memory bus, a memory controller, a peripheral bus, an external bus, a crossbar switch, and/or a local bus, among others.

Further, the connection between components of the computer system 300, or any other type of connection between computer-related components described herein may be referred to an operable connection, and may include a connection by which entities are operably connected, such that signals, physical communications, and/or logical communications may be sent and/or received. An operable connection may include a physical interface, a data interface and/or an electrical interface.

The computer system 300 may include a display interface 302 that forwards graphics, text, and other data from the communication infrastructure 306 (or from a frame buffer not shown) for display on a display unit 330. The computer system 300 also includes a main memory 308, preferably random access memory (RAM), and may also include a secondary memory 310. The secondary memory 310 may include, for example, a hard disk drive 312 and/or a removable storage drive 314, representing a floppy disk drive, a magnetic tape drive, an optical disk drive, etc. The removable storage drive 314 reads from and/or writes to a removable storage unit 318 in a well-known manner. The removable storage unit 318, represents a floppy disk, magnetic tape, optical disk, etc., which is read by and written to removable storage drive 314. As will be appreciated, the removable storage unit 318 includes a computer usable storage medium having stored therein computer software and/or data.

In alternative aspects, the secondary memory 310 may include other similar devices for allowing computer programs or other instructions to be loaded into the computer system 300. Such devices may include, for example, a removable storage unit 322 and an interface 320. Examples of such may include a program cartridge and cartridge interface (such as that found in video game devices), a removable memory chip (such as an erasable programmable read only memory (EPROM), or programmable read only memory (PROM)) and associated socket, and other removable storage units 322 and interfaces 320, which allow software and data to be transferred from the removable storage unit 322 to the computer system 300.

It should be understood that a memory, as used herein may include volatile memory and/or non-volatile memory. Non-volatile memory may include, for example, ROM (read only memory), PROM (programmable read only memory), EPROM (erasable PROM) and EEPROM (electrically erasable PROM). Volatile memory may include, for example, RAM (random access memory), synchronous RAM (SRAM), dynamic RAM (DRAM), synchronous DRAM (SDRAM), double data rate SDRAM (DDR SDRAM), and/or direct RAM bus RAM (DRRAM).

The computer system 300 may also include a communications interface 324. In an example, the communications interface 324 may be an example of the primary interface 120 and/or the secondary interface 122, described herein. The communications interface 324 allows software, data, power, or signals to be transferred between computer system 300 and the addressable initiating devices 110, notification appliances 112, and/or external devices. Examples of the communications interface 324 may include a modem, a network interface (such as an Ethernet card), a communications port, a Personal Computer Memory Card International Association (PCMCIA) slot and card, etc. Software and data transferred via the communications interface 324 are in the form of signals 328, which may be electronic, electromagnetic, optical or other signals capable of being received by communications interface 324. These signals 328 are provided to the communications interface 324 via a communications path (e.g., channel) 326. This path 326 carries signals 328 and may be implemented using wire or cable, fiber optics, a telephone line, a cellular link, a radio frequency (RF) link and/or other communications channels. In this document, the terms "computer program medium" and "computer usable medium" are used to refer generally to media such as a removable storage drive 314, a hard disk installed in hard disk drive 312, and the signals 328. These computer program products provide software to the computer system 300. Aspects of the disclosure are directed to such computer program products.

Computer programs (also referred to as computer control logic) are stored in the main memory 308 and/or the secondary memory 310. Computer programs may also be received via the communications interface 324. Such computer programs, when executed, enable the computer system 300 to perform various features in accordance with aspects of the present disclosure, as discussed herein. In particular, the computer programs, when executed, enable the processor 304 to perform the methods and techniques described herein. Accordingly, such computer programs represent controllers of the computer system 300.

In variations where aspects of the disclosure are implemented using software, the software may be stored in a computer program product and loaded into the computer system 300 using the removable storage drive 314, the hard drive 312, or the communications interface 320. The control logic (software), when executed by the processor 304, causes the processor 304 to perform the functions in accordance with aspects of the disclosure as described herein. In another variation, aspects are implemented primarily in hardware using, for example, hardware components, such as application specific integrated circuits (ASICs), primary logic devices (PLDs), or other programmable chips. Implementation of the hardware state machine so as to perform the functions described herein will be apparent to persons skilled in the relevant art(s).

In yet another example variation, aspects of the disclosure are implemented using a combination of both hardware and software.

Figure 4:
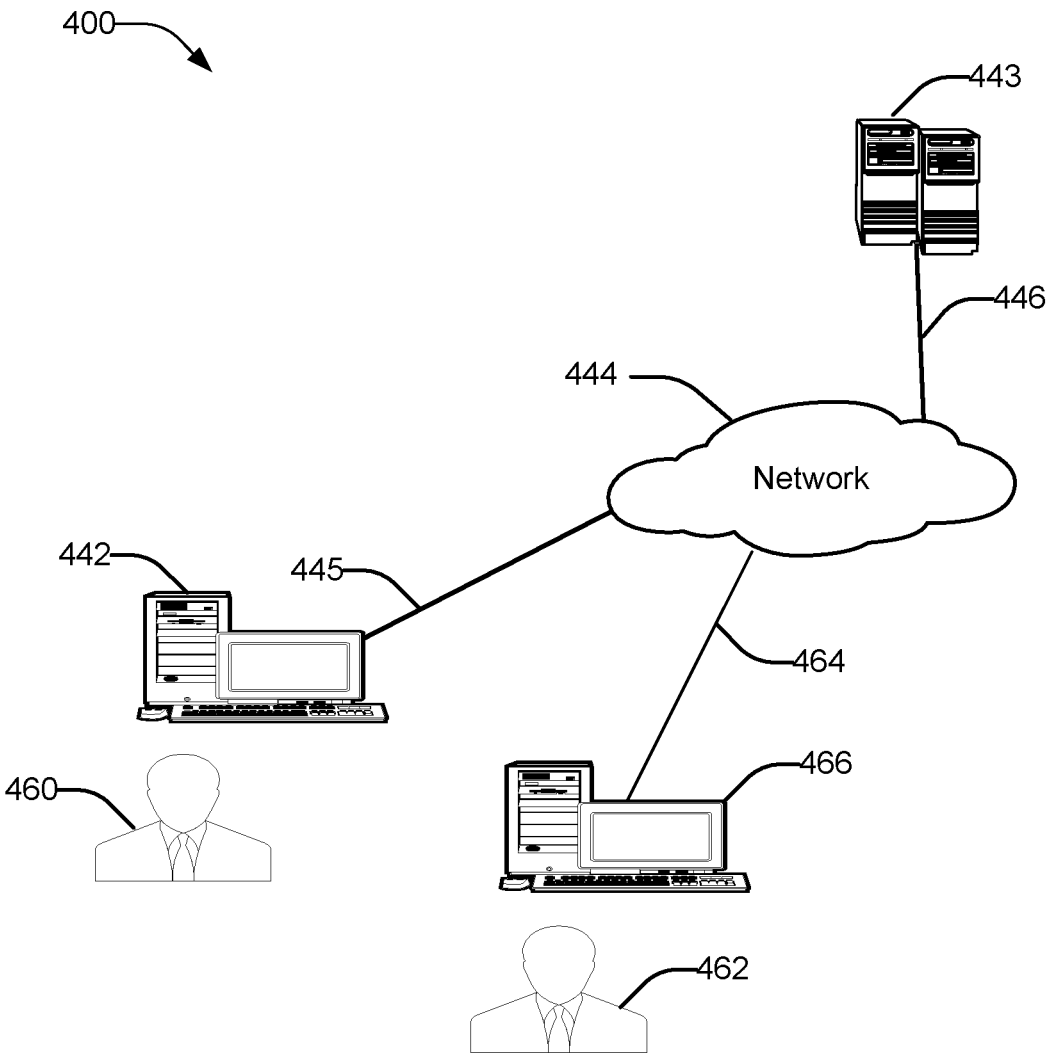
FIG. 4 is a block diagram of various example system components that implement the addressable detection and alarm system of FIGS. 1A-1C, for use in accordance with aspects of the present disclosure.

FIG. 4 is a block diagram of various example system components that may be used in accordance with aspects of the present disclosure. For example, the various components may be within the detection and alarm system 100, or only some of the components may be within the detection and alarm system 100, and other components may be remote from the detection and alarm system 100. The system 400 includes one or more accessors 460, 462 (also referred to interchangeably herein as one or more "users" or persons seeking to gain access to a location) and one or more terminals 442, 466 (such terminals may be or include, for example, various features of the control panel 102 and/or computer system 300). In one aspect, data for use in accordance with aspects of the present disclosure is, for example, input and/or accessed by accessors 460, 462 via terminals 442, 466, such as personal computers (PCs), minicomputers, mainframe computers, microcomputers, telephonic devices, or wireless devices, such as personal digital assistants ("PDAs") or a hand-held wireless devices coupled to a server 443, such as a PC, minicomputer, mainframe computer, microcomputer, or other device having a processor and a repository for data and/or connection to a repository for data, via, for example, a network 444, such as the Internet or an intranet, and couplings 445, 446, 464. The couplings 445, 446, 464 include, for example, wired, wireless, or fiber optic links. In another example variation, the method and system in accordance with aspects of the present disclosure operate in a stand-alone environment, such as on a single terminal.

The aspects of the disclosure discussed herein may also be described and implemented in the context of computer-readable storage medium storing computer-executable instructions. Computer-readable storage media includes computer storage media and communication media. For example, flash memory drives, digital versatile discs (DVDs), compact discs (CDs), floppy disks, and tape cassettes. Examples of computer-readable storage media may include volatile and nonvolatile, transitory and non-transitory, removable and non-removable media implemented in any method or technology for storage of information such as computer readable instructions, data structures, modules or other data.

It will be appreciated that various implementations of the above-disclosed and other features and functions, or alternatives or varieties thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. An addressable detection and alarm system, comprising:

a combined circuit including paired wires, one or more addressable initiating devices, and one or more non-addressable notification appliances communicatively coupled with the paired wires in parallel; and a control panel having a controller communicatively coupled with the combined circuit via the paired wires, the controller configured to:

receive, on the paired wires, an indication of an anomaly from an addressable initiating device of the one or more addressable initiating devices;

determine to transmit an alarm signal in response to the indication of the anomaly being received; and transmit, on the paired wires, the alarm signal to the one or more addressable initiating devices and the one or more non-addressable notification appliances, wherein a first state of the alarm signal activates the one or more non-addressable notification appliances and deactivates the one or more addressable initiating devices, and wherein a second state of the alarm signal deactivates the one or more non-addressable notification appliances and activates the one or more addressable initiating devices.

2. The addressable detection and alarm system of claim 1, wherein the controller is further configured to:

monitor the one or more addressable initiating devices while the control panel is in a standby mode;

maintain the one or more non-addressable notification appliances in an off state while the control panel is in the standby mode; and transition to an alarm mode in response to the indication of the anomaly being received.

3. The addressable detection and alarm system of claim 1, wherein the controller is further configured to:

monitor the one or more addressable initiating devices in the second state of the alarm signal.

4. The addressable detection and alarm system of claim 1, wherein the alarm signal is a pulsed signal, and wherein the first state of the alarm signal is a first binary logic state and the second state of the alarm signal is a second binary logic state different from the first binary logic state.

5. The addressable detection and alarm system of claim 1, wherein the combined circuit is communicatively coupled with the controller at a primary interface via the paired wires, and wherein the detection and alarm system further comprise a return line communicatively coupled with the combined circuit and the controller at a secondary interface via the paired wires.

6. The addressable detection and alarm system of claim 1, wherein the one or more addressable initiating devices comprise one or more pull switches or one or more fire detectors.

7. The addressable detection and alarm system of claim 1, wherein the one or more non-addressable notification appliances comprise one or more visual alarms or one or more audio alarms.

8. A method of controlling, by a control panel, a combined circuit including paired wires, one or more addressable initiating devices, and one or more non-addressable notification appliances communicatively coupled with the paired wires in parallel, the method comprising:

receiving, on the paired wires, an indication of an anomaly from an addressable initiating device of the one or more initiating devices;

determining to transmit an alarm signal in response to the indication of the anomaly being received; and transmitting, on the paired wires, the alarm signal to the one or more addressable initiating devices and the one or more non-addressable notification appliances, wherein a first state of the alarm signal activates the one or more non-addressable notification appliances and deactivates the one or more addressable initiating devices, and wherein a second state of the alarm signal deactivates the one or more non-addressable notification appliances and activates the one or more addressable initiating devices.

9. The method of claim 8, further comprising:

monitoring the one or more addressable initiating devices while the control panel is in a standby mode;

maintaining the one or more non-addressable notification appliances in an off state while the control panel is in the standby mode; and transitioning to an alarm mode in response to receiving the indication of the anomaly.

10. The method of claim 8, further comprising:

monitoring the one or more addressable initiating devices in the second state of the alarm signal.

11. The method of claim 8, wherein the alarm signal is a pulsed signal, and wherein the first state of the alarm signal is a first binary logic state and the second state of the alarm signal is a second binary logic state different from the first binary logic state.

12. The method of claim 8, wherein the combined circuit is communicatively coupled with the control panel at a primary interface via the paired wires, and wherein the combined circuit further includes a return line communicatively coupled with the combined circuit and the control panel at a secondary interface via the paired wires.

13. The method of claim 8, wherein the one or more addressable initiating devices comprise one or more pull switches or one or more smoke detectors.

14. The method of claim 8, wherein the one or more non-addressable notification appliances comprise one or more visual alarms or one or more audio alarms.

15. A non transitory computer-readable medium storing instructions for controlling addressable detection and alarm system comprising a control panel, a combined circuit including paired wires, one or more addressable initiating devices, and one or more non-addressable notification appliances communicatively coupled with the paired wires in parallel, comprising instructions to:

receive, on the paired wires, an indication of an anomaly from an addressable initiating device of the one or more initiating devices;

determine to transmit an alarm signal in response to the indication of the anomaly being received; and transmit, on the paired wires, the alarm signal to the one or more addressable initiating devices and the one or more non-addressable notification appliances, wherein a first state of the alarm signal activates the one or more non-addressable notification appliances and deactivates the one or more addressable initiating devices, and wherein a second state of the alarm signal deactivates the one or more non-addressable notification appliances and activates the one or more addressable initiating devices.

16. The non transitory computer-readable medium of claim 15, further comprising instructions to:

monitor the one or more addressable initiating devices while the control panel is in a standby mode;

maintain the one or more non-addressable notification appliances in an off state while the control panel is in the standby mode; and transition to an alarm mode in response to the indication of the anomaly being received.

17. The non transitory computer-readable medium of claim 15, further comprising instructions to:

monitor the one or more addressable initiating devices in the second state of the alarm signal.

18. The non transitory computer-readable medium of claim 15, monitor the one or more addressable initiating devices in the second state of the alarm signal.

19. The non transitory computer-readable medium of claim 15, wherein the combined circuit is communicatively coupled with the control panel at a primary interface, and wherein the combined circuit further includes a return line communicatively coupled with the combined circuit and the control panel at a secondary interface.

20. The non transitory computer-readable medium of claim 15, wherein the one or more addressable initiating devices comprise one or more pull switches or one or more smoke detectors, and the one or more non-addressable notification appliances comprise one or more visual alarms or one or more audio alarms.

* * * * *